US010093401B2

(12) United States Patent
Myerscough

(10) Patent No.: US 10,093,401 B2
(45) Date of Patent: Oct. 9, 2018

(54) DIVING DRY SUIT HAVING ZIPPERED FRONT COMPRESSION FLAPS

(75) Inventor: Richard Kerr Myerscough, Victoria (CA)

(73) Assignee: Whites Manufacturing Ltd., Victoria, BC (CA)

( * ) Notice: Subject to any disclaimer, the term of this patent is extended or adjusted under 35 U.S.C. 154(b) by 0 days.

(21) Appl. No.: 14/129,159

(22) PCT Filed: Jun. 19, 2012

(86) PCT No.: PCT/IB2012/053091

§ 371 (c)(1),
(2), (4) Date: Dec. 24, 2013

(87) PCT Pub. No.: WO2013/001413

PCT Pub. Date: Jan. 3, 2013

(65) Prior Publication Data

US 2014/0115744 A1 May 1, 2014

Related U.S. Application Data

(60) Provisional application No. 61/501,904, filed on Jun. 28, 2011.

(51) Int. Cl.

| | |
|---|---|
| ***B63C 11/04*** | (2006.01) |
| ***A41D 13/012*** | (2006.01) |
| *A41D 15/00* | (2006.01) |

(52) U.S. Cl.

CPC ..... *B63C 11/04* (2013.01); *A41D 13/012* (2013.01); *A41D 15/002* (2013.01); *A41D 2300/24* (2013.01); *B63C 2011/043* (2013.01)

(58) Field of Classification Search

CPC ..... B63C 11/04; B63C 2011/046; B63C 2011/043; B63C 9/087; B63C 9/1055;

(Continued)

(56) References Cited

U.S. PATENT DOCUMENTS

| | | | | |
|---|---|---|---|---|
| 1,214,478 A | | 1/1917 | Magnus | |
| 2,749,551 A | * | 6/1956 | Garbellano | 2/82 |

(Continued)

FOREIGN PATENT DOCUMENTS

| | | |
|---|---|---|
| FR | 1226217 A | 7/1960 |
| FR | 2249627 A1 | 5/1975 |

OTHER PUBLICATIONS

Written Opinion dated Sep. 11, 2012, issued in corresponding International Application No. PCT/IB2012/053091, filed Jun. 19, 2012, 5 pages.

(Continued)

*Primary Examiner* — Alissa L Hoey
*Assistant Examiner* — Catherine M Ferreira
(74) *Attorney, Agent, or Firm* — Michael J. Bujold; Davis & Bujold, PLLC

(57) ABSTRACT

A dry suit having detachable or permanent zippered compression flaps. The compression flaps can be disposed over the front or the back of a dry suit. The compression flaps are used to gather and hide excess dry suit materials and dry zipper ends under the compression flaps. The compression flaps form a tunnel around the wearer under which a kayak spray skirt or a kite boarding/surfboarding harness can be worn.

5 Claims, 13 Drawing Sheets

(58) Field of Classification Search

CPC ..... B63C 11/02; B63C 9/093; A41D 13/012; A41D 13/02; A41D 13/0005; A41D 3/00; A41D 2300/322; A41D 2400/24; A41D 7/00; A41D 13/0015; A41D 13/005; A41D 13/129; A41D 2300/322; A41D 1/08; A41D 2200/20; A41D 13/00; A41D 13/0025; A41D 13/01; A41D 13/015; A41D 13/0512; A41D 13/0518; A41D 2300/30; A41D 1/04; A41D 2400/44; A41D 2600/106; A41D 2600/108

USPC ..... 2/2.15, 2.16, 2.17, 2.135, 109, 108, 125, 2/69, 2.1

See application file for complete search history.

(56) References Cited

U.S. PATENT DOCUMENTS

| | | | | | |
|---|---|---|---|---|---|
| 2,871,849 | A | * | 2/1959 | Clark et al. | 600/20 |
| 3,771,169 | A | | 11/1973 | Edmund | |
| 4,293,957 | A | * | 10/1981 | Melarvie | 2/2.17 |
| 4,483,019 | A | * | 11/1984 | Spangrud et al. | 2/2.16 |
| 4,547,904 | A | * | 10/1985 | Long et al. | 2/2.16 |
| 4,563,157 | A | * | 1/1986 | Hoshino | 441/104 |
| 5,159,719 | A | * | 11/1992 | Aumann | A41F 1/00 2/82 |
| 5,802,609 | A | * | 9/1998 | Garofalo | 2/2.17 |
| 5,898,934 | A | * | 5/1999 | Hunter et al. | 2/2.15 |
| 5,918,314 | A | * | 7/1999 | Moses | A41D 13/02 2/164 |
| 6,119,270 | A | * | 9/2000 | Chou | 2/108 |
| 6,223,349 | B1 | * | 5/2001 | Roiser | A44B 19/32 2/2.15 |
| 6,415,449 | B2 | * | 7/2002 | Duplock | A41D 13/012 112/419 |
| 7,188,371 | B2 | * | 3/2007 | Ragot | 2/82 |
| 8,006,317 | B2 | * | 8/2011 | Taylor et al. | 2/2.16 |
| D648,924 | S | * | 11/2011 | Propst | D2/828 |
| 8,104,101 | B2 | * | 1/2012 | Nocente et al. | 2/456 |
| 8,561,212 | B2 | * | 10/2013 | Saotome | 2/2.17 |
| 2003/0115653 | A1 | * | 6/2003 | Myerscough | 2/2.15 |
| 2007/0277278 | A1 | * | 12/2007 | O'Brien | B63C 9/087 2/2.17 |
| 2010/0100994 | A1 | * | 4/2010 | Ehlme | 2/2.16 |

OTHER PUBLICATIONS

International Search Report dated Sep. 11, 2012, issued in corresponding International Application No. PCT/IB2012/053091, filed Jun. 19, 2012, 4 pages.

https://www.youtube.com/watch?v=utM7NbRGF9k, Ocean Rodeo: "Donning the Predator Surf Dry Suit", Jul. 26, 2010, 2 pages. See Supplementary EP Search Report.

Supplementary European Search Report dated Dec. 4, 2015, issued in corresponding European Application No. 12805365.9, 9 pages.

* cited by examiner

DIVING DRY SUIT HAVING ZIPPERED FRONT COMPRESSION FLAPS

TECHNICAL FIELD

This invention relates to underwater diving equipment and more particularly to dry diving suits worn by professional and sports divers and kayakers for warmth and protection while diving and kayaking, and specifically a dry suit having zippered compression overlaying flaps that gather a closed dry zipper of a dry-suit into a body conforming fit.

BACKGROUND ART

Underwater diving in cold water requires a dry diving suit that is capable of insulating the diver from the temperature of the ambient water and its deleterious effects. Kayakers who ply northern waters also require effective thermal insulation in their clothing. Kayakers often rely upon dry suits. Dry suits are bulky garments due to the fact the wearer wears insulating undergarments. As a result a dry suit often has excess material that bulges and pillows on the wearer. These bulges and pillows can trap air that can make buoyancy control difficult for a diver. For a kayaker, who must fit into the hatch way of a kayak, additional bulky material can impede the proper fit of a skirt seal. Therefore, there is a requirement for a dry suit that can be, as much as possible, for fit to the wearer to avoid the deficiencies noted above.

DISCLOSURE OF INVENTION

Technical Problem

Technical Solution

It is an object of the present invention to provide a dry diving suit having overlaying compression flaps that zip opened and closed. The overlaying zippered compression flaps gather the excess dry suit material and dry-zipper ends required to don and doff the suit, while at the same time providing abrasion protection for the dry zipper. In this way, awkward bulges and pillows of material and dry-zipper bulk can be eliminated by positioning the excess fabric and zip ends in a controlled comfortable location on the dry-suit. The compression zip flap design doubles as water proof barrier for add on accessories such as kayak spray skirts, sailing harnesses, or waist belts of other functions.

Advantageous Effects

BEST MODE

Mode for Invention

Figure 1:
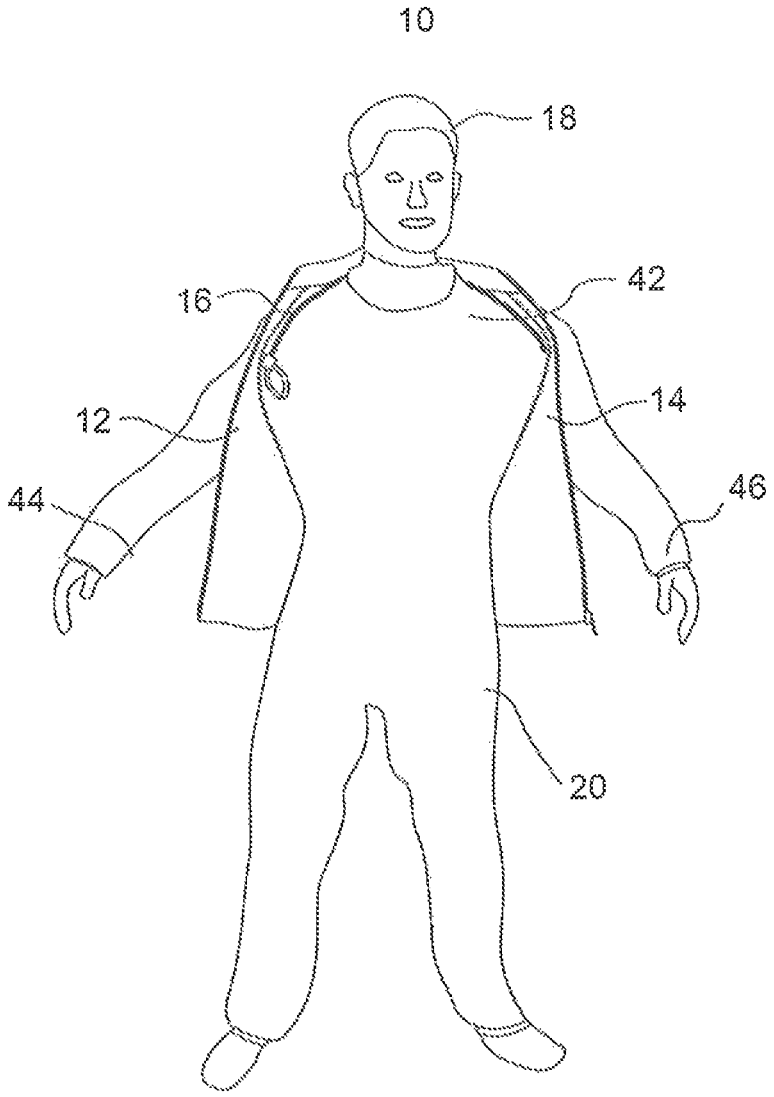
FIG. 1 is a drawing of one embodiment of the invention on a dry suit.

Referring to FIG. 1, there is shown one embodiment of the invention 10 which is a diving dry suit having a first compression flap 12 and a compression second flap 14 secured to the dry suit. In the embodiment illustrated the compression flaps are disposed over the front of the dry suit. In another embodiment, the compression flaps can be disposed over the back of the dry suit. A dry zipper 16 provides an access for the wearer 18 to don and doff the dry suit 20. The first and second compression flaps are attached to the dry suit by suitable waterproof stitching. Once the compression flaps are closed and zippered together they form a 'tunnel' under which other equipment can be worn such as a kayak spray skirt or a kite boarding harness. In FIG. 1, when the compression flaps are open, the zipper 16 is in a position wherein the wearer can easily open it to exit the dry suit. When the compression flaps are closed and zippered up, the ends of the dry suit zipper 16 (dry zip ends) are drawn away from the arm pits of the wearer so as not to cause uncomfortable abrasion.

The compression flaps can be permanently sewn to the dry suit or they can be temporarily attached by hook and loop fasteners, zippers or button snaps.

Figure 2:
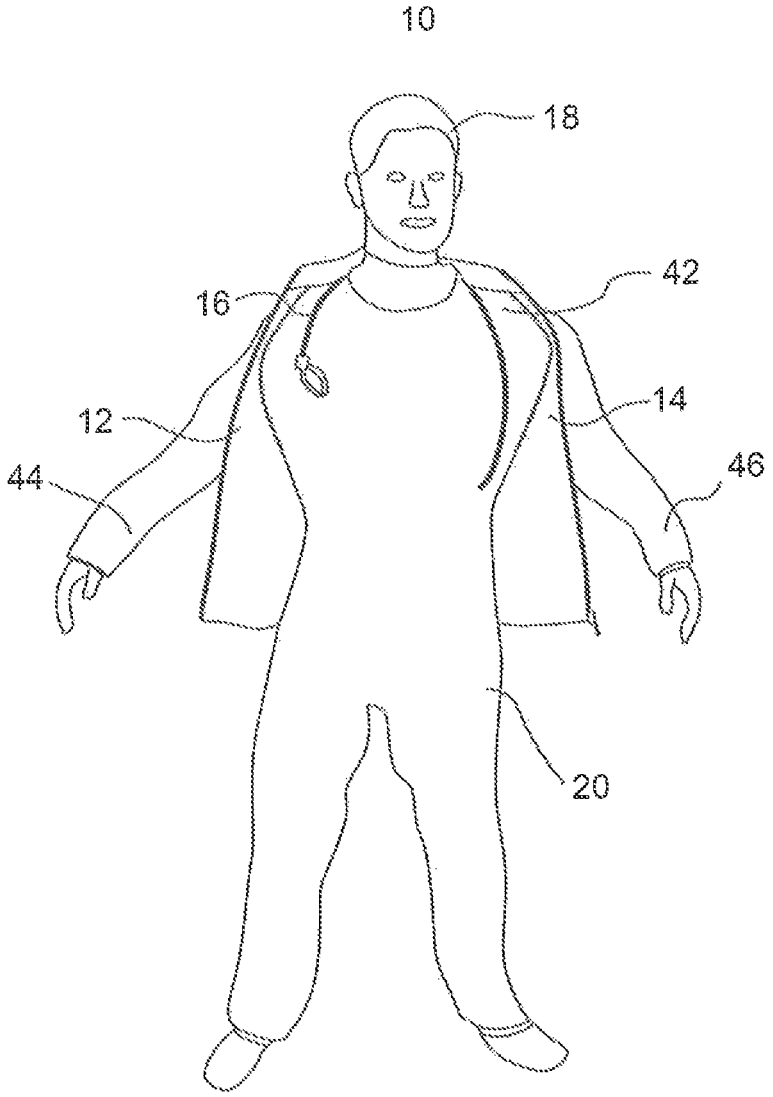
FIG. 2, FIG. 3, FIG. 4 and FIG. 5 are drawings of another embodiment of the invention on dry suits having different zipper configurations.
Figure 3:
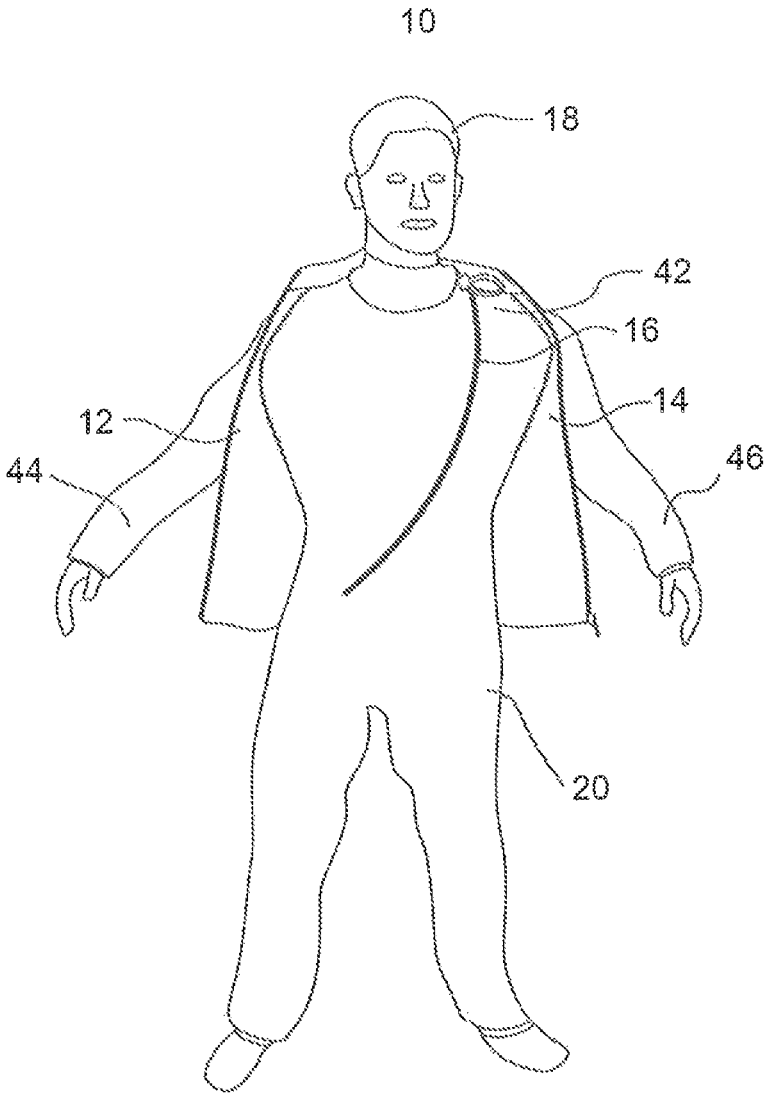
Figure 4:
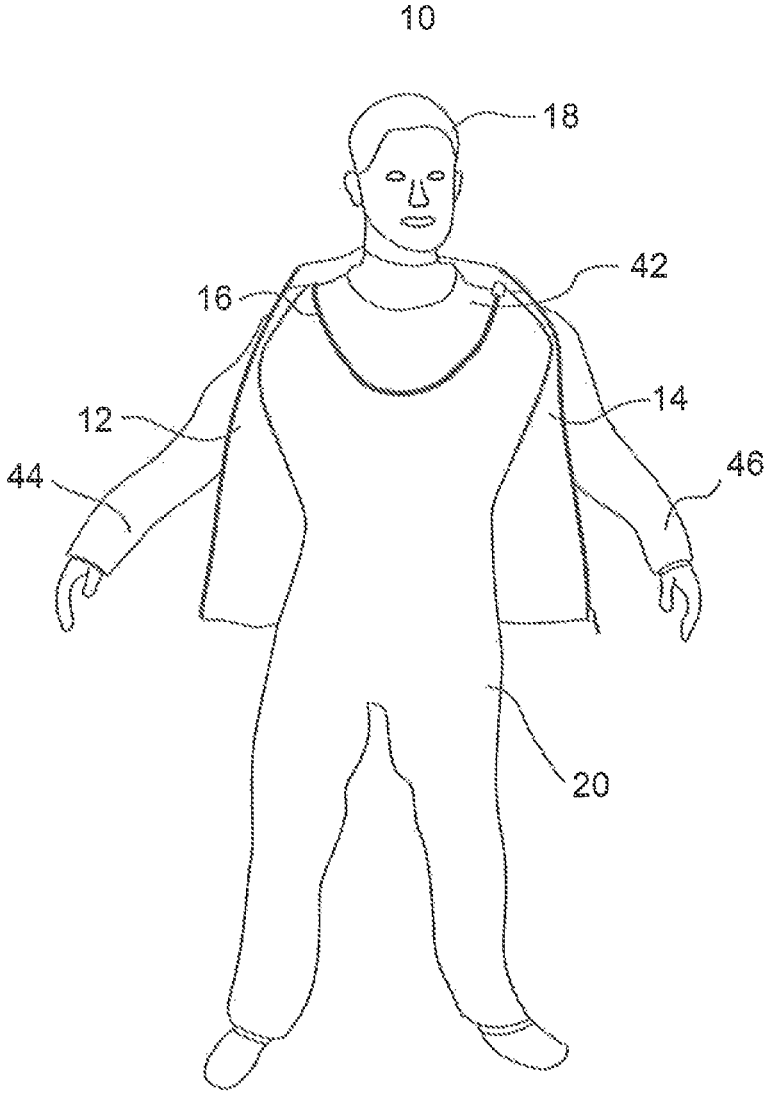
Figure 5:
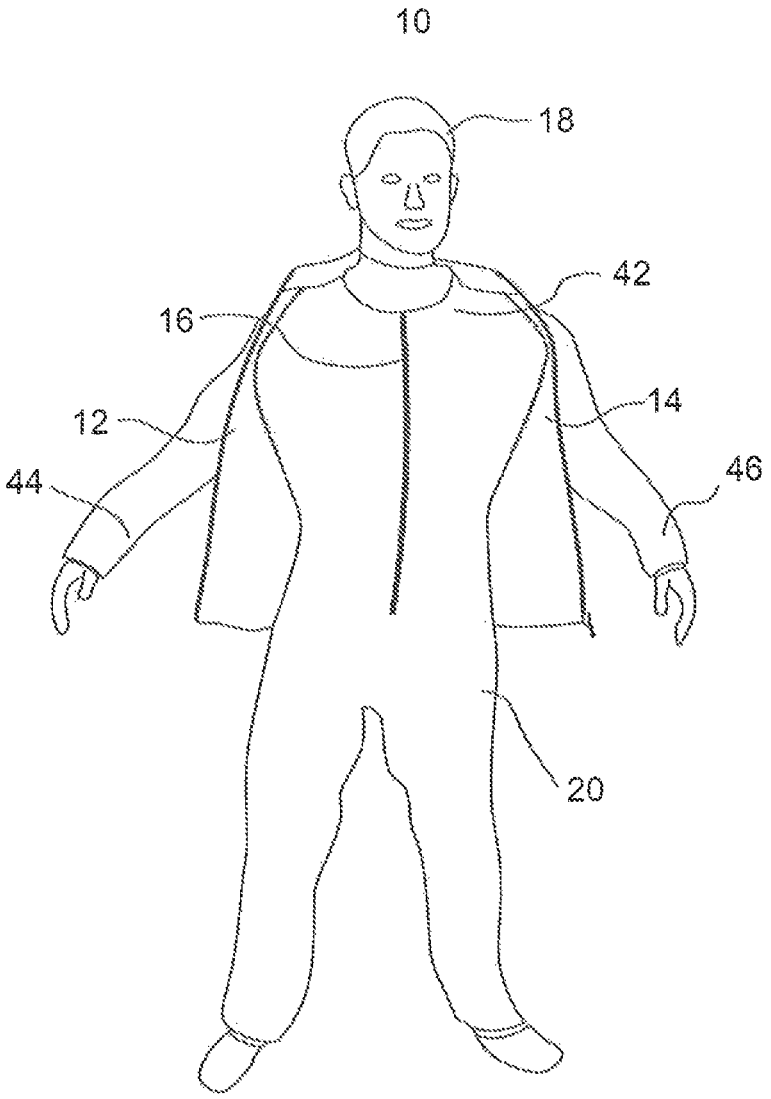

Referring to FIG. 2 there is shown one embodiment of the invention being used with a dry suit having a first zipper configuration, in the shape of an inverted U around the wearer's 18 neck, with the ends of the zipper being offset. FIG. 3 shows the same embodiment of FIG. 2 being used with a dry suit having a second zipper configuration, in a diagonal line across the wearer's 18 chest. FIG. 4 shows the same embodiment of the invention being used with a third and zipper configuration, in a U shape on the wearer's 18 upper chest. FIG. 5 shows the same embodiment of the invention being used with a with a dry suit having a fourth zipper configuration, in a vertical line on the wearer's 18 chest. The compression flaps can be made from a stretch material or a non-stretch material and can be permanently or temporarily fixed to the dry suit to accommodate any entry/exit zipper configuration on the dry suit.

Advantageously, the zippered compression flaps need not be waterproof and accessory pockets, safety line attachments and brand patches can be sewn directly to the flaps.

Figure 6:
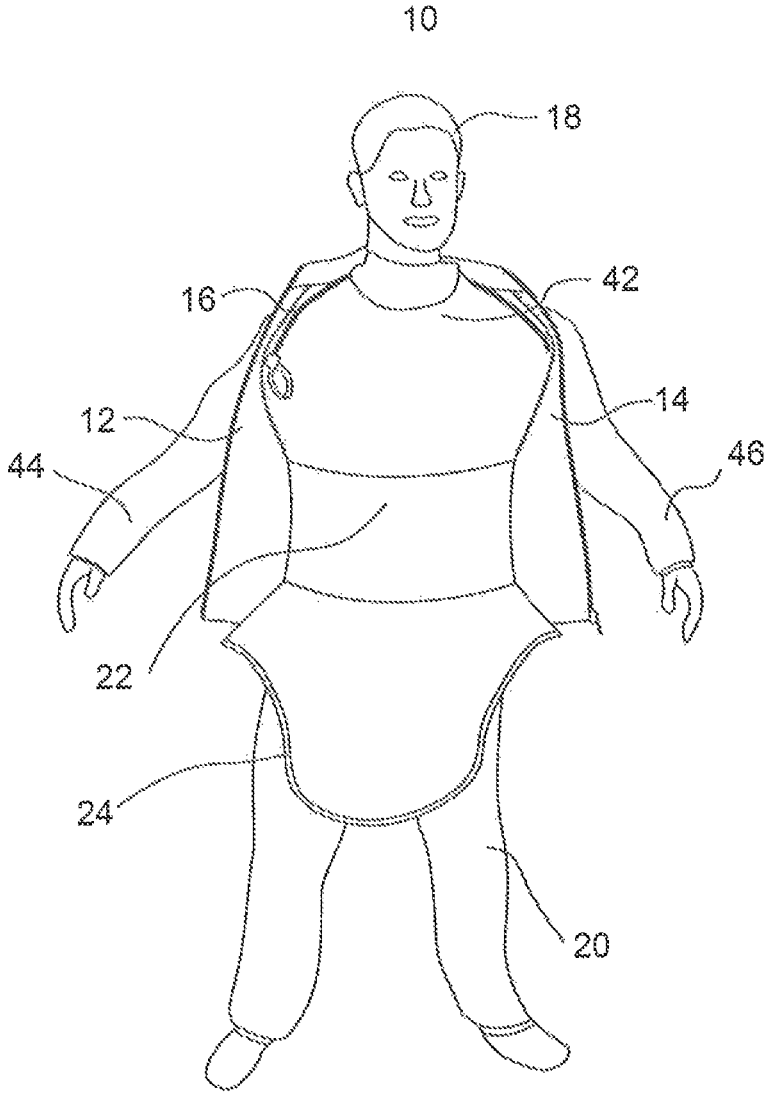
FIG. 6 and FIG. 7 drawings of another embodiment of the invention used with a kayak spray skirt.
Figure 7:
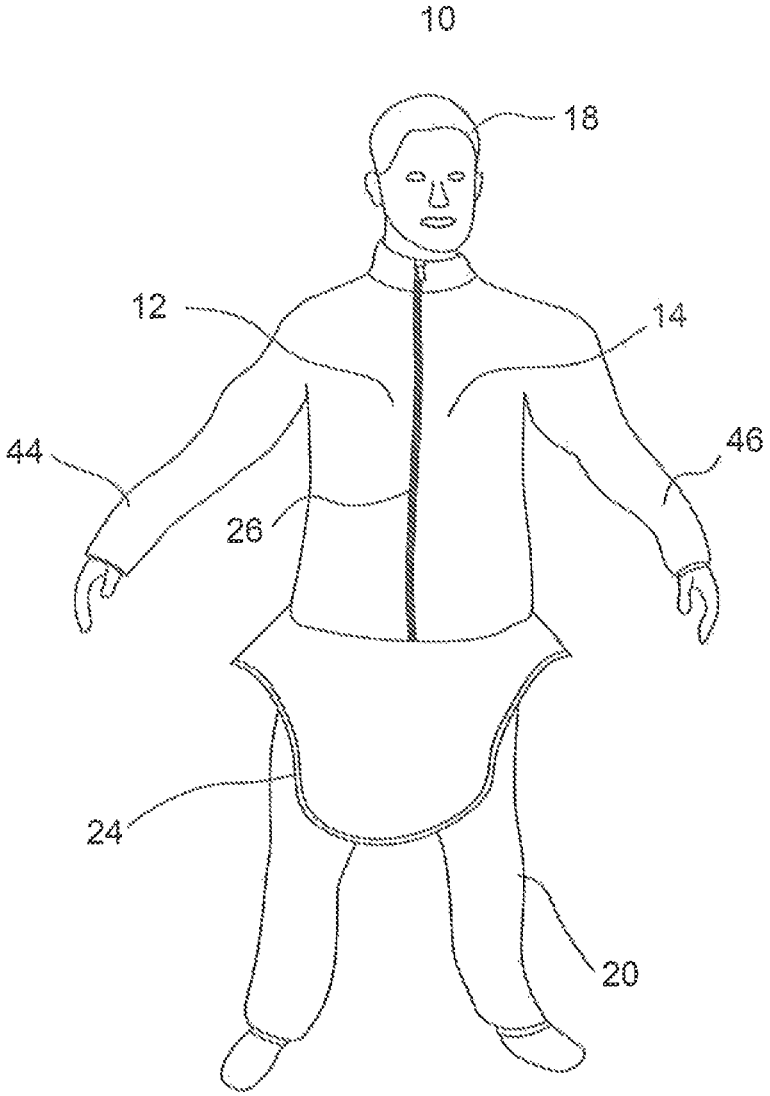

Referring to FIG. 6 and FIG. 7 there is shown one embodiment of the invention used with a kayak spray skirt. The top or tunnel portion 22 of the spray skirt forms a dry seal between the body of the wearer and the kayak. The skirt or cover portion 24 of the spray skirt fits over the spray skirt flange of a kayak. From FIG. 6 the spray skirt can be worn over a dry suit such that the tunnel portion wraps around the midsection of the wearer. Once the compression flaps 12 and 14 are zippered 26 into place, the tunnel portion is hidden under the compression flaps and the skirt hangs down from the zippered flaps as shown in FIG. 7. FIG. 7 also shows how the compression flaps prevent the bulk of the dry suit from interfering with the wearer since the excess dry suit material is captured and contained by the compression flaps. When the compression flaps are zippered together they form a tunnel around the wearer and the waist of the dry suit. Under the compression flaps the tunnel portion of the kayak spray skirt is disposed in a snag-free position since it is covered by the compression flaps. The zipper between the compression flaps can be opened and closed by the wearer to adjust the kayak skirt.

Figure 8:
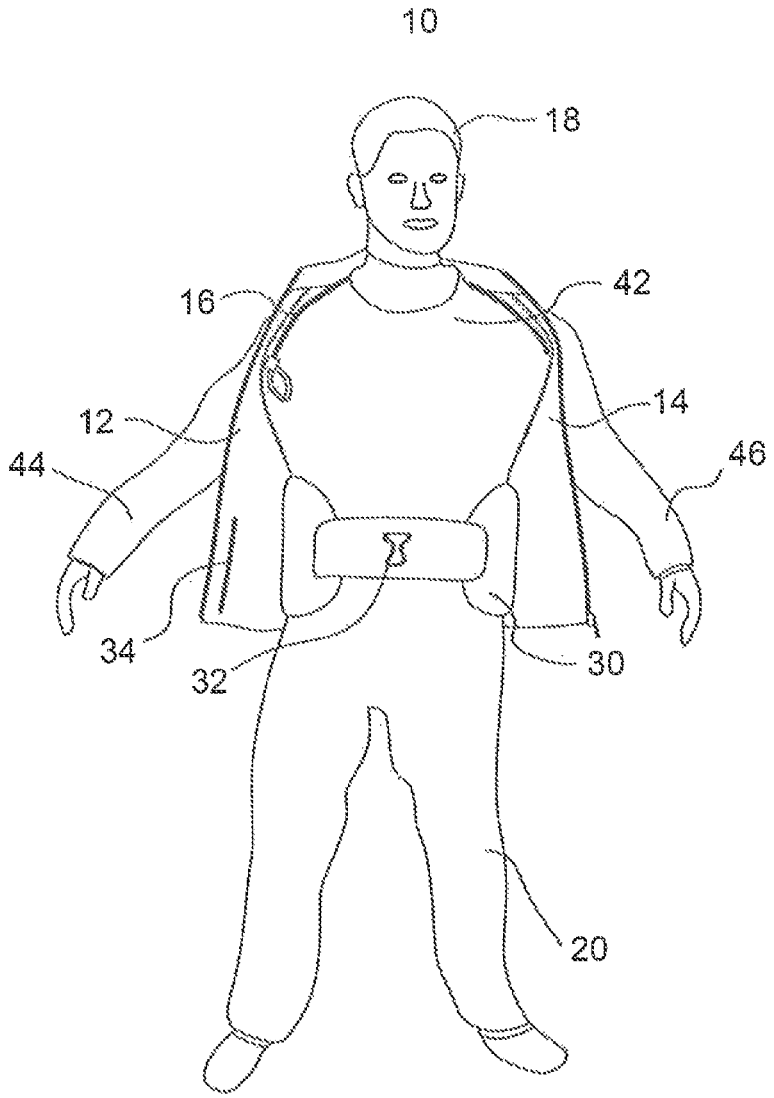
FIG. 8 and FIG. 9 are drawings of yet another embodiment of the invention used with a windsurfing/kite boarding harness.
Figure 9:
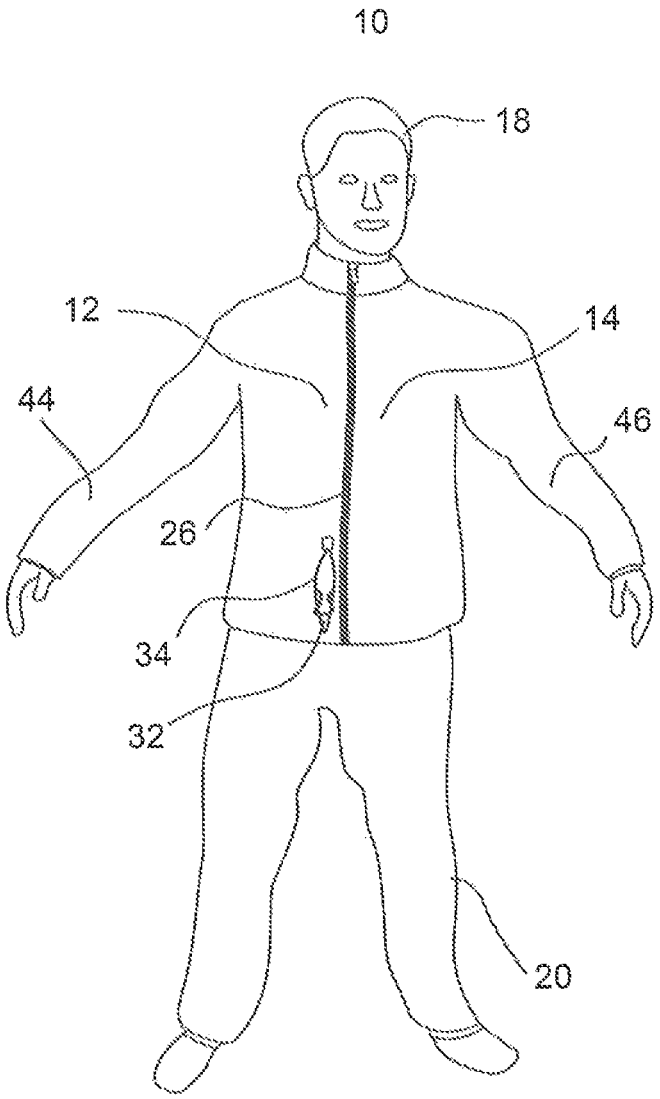

Referring to FIG. 8 and FIG. 9, FIG. 8 shows one embodiment of the invention used with a harness 30 for kite boarding or wind boarding. The harness 30 includes a hook 32. The harness can be worn over the dry suit as shown. Then, once the compression flaps 12 and 14 are zipped up 26, as shown in FIG. 9, the hook can be exposed through a hole or zippered aperture 34. The zippered compression flaps maintain a relatively clean exterior to the dry suit so that the windsurfer or kite boarder is not impeded by excess.

Figure 10:
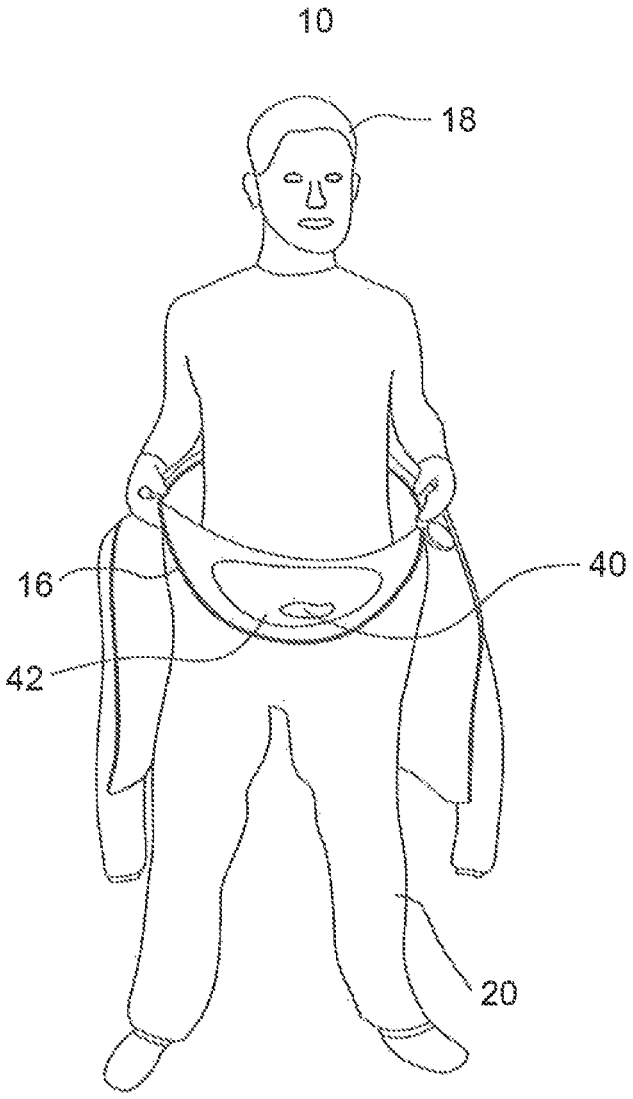
FIG. 10, FIG. 11 FIG. 12 and FIG. 13 are sequential drawings of one embodiment of the invention being donned by a user.
Figure 11:
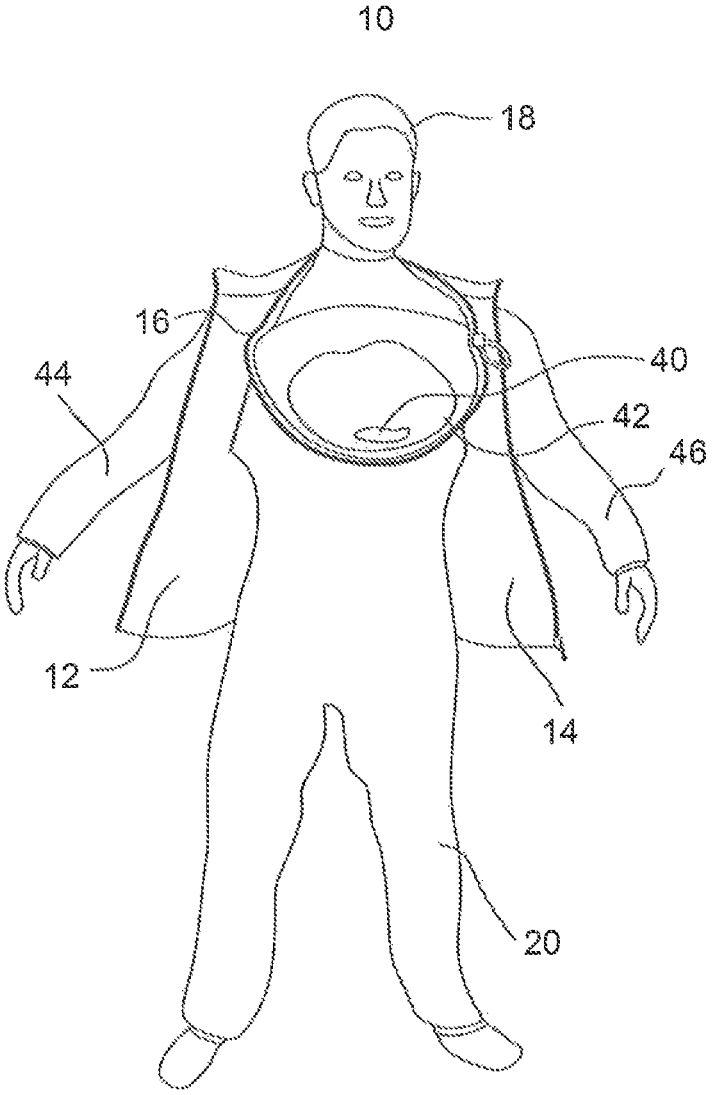
Figure 12:
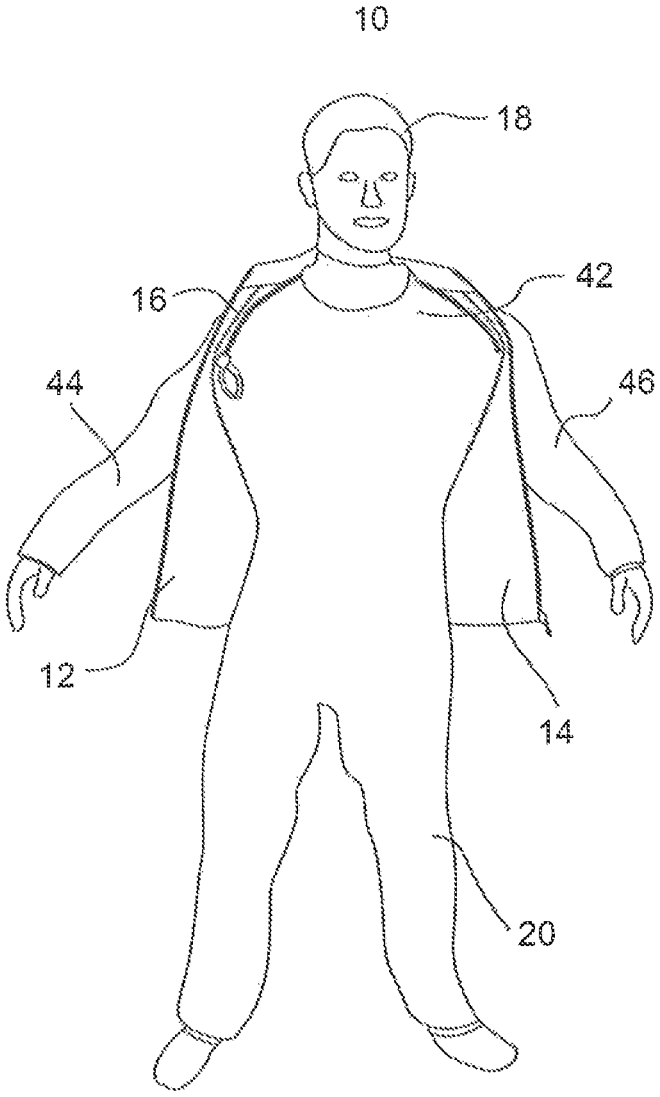
Figure 13:
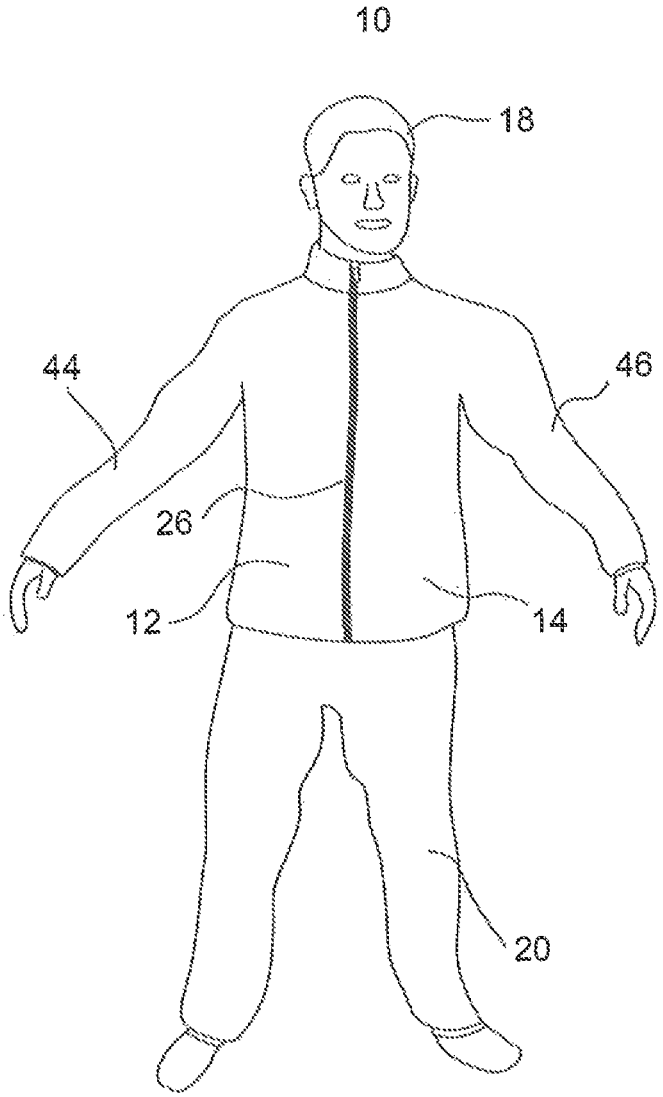

Referring to FIG. 10, FIG. 11, FIG. 12 and FIG. 13 there is shown the steps a wearer 18 would take to don a dry suit with zippered compression flaps attached. In FIG. 10 the neck opening 40 is un-zipped and open. The top portion of the dry suit 42 hangs on the front of the wearer 18. The wearer places legs first into the dry suit as shown. In FIG. 11 the wearer 18 places arms into the arms of the suit 44 and 46. The compression flaps 12 and 14 are shown in their unzipped state. In FIG. 12 the top portion of the dry suit 42 is placed over the head of the wearer 18 and the zipper 16 is closed. The wearer then gathers the excess material and compression flap zipper ends in the front of the dry suit. The compression flaps 12 and 14 are folded in the front of the wearer with the excess material gathered under the compression flaps. The compression flaps are then zippered together 26 as shown in FIG. 13. The result is that the dry suit takes on a less bulky and cumbersome appearance and is more comfortable for the user.

The invention claimed is:

1. A dry suit comprising:

a dry suit body comprising a torso portion, right and left leg portions, and right and left arm portions, and the dry suit body having an access opening, the access opening is closable by a dry zipper, the dry zipper extending across a back, over each shoulder and down a top front panel of the torso portion of the dry suit body on opposite sides of a neck opening, the dry suit body having excess dry suit material in a vicinity of armpits of the dry suit body to increase a size of the access opening and facilitate entry and exit by a wearer, and when the wearer is wearing the dry suit and the dry zipper is closed, at least a portion of the torso portion of the dry suit body, adjacent the armpits of the wearer, is oversized;

a jacket portion comprising right and left torso panel portions, the right and the left torso panel portions extending from a shoulder area and terminating above the right and left leg portions of the dry suit body;

the left torso panel portion being attached longitudinally along an exterior left side of the torso portion of the dry suit body by a first waterproof seam and the first waterproof seam extending from an area of a left shoulder to an area of a waist of the torso portion of the dry suit body;

the right torso panel portion being attached longitudinally along an exterior right side of the torso portion of the dry suit body by a second waterproof seam and the second waterproof seam extending from an area of a right shoulder to an area of the waist of the torso portion of the dry suit body;

a first fastener permanently secured along an entire length of an edge of the left torso panel portion and a mating second fastener permanently secured along an entire length of an edge of the right torso panel portion; and during use, the right and the left torso panel portions being fastened together, by mating first and second fasteners, so that the right torso panel portion and the left torso panel portion join one another at a front midpoint of the torso portion of the dry suit body and overlap at least a portion of the dry zipper and at least a front of the torso portion of the dry suit body, and as the right and the left torso panel portions join one another at the front midpoint of the torso portion of the dry suit body, the right and the left torso panel portions compress and pull the excess dry suit material away from the armpits of the wearer so that the dry suit body is sized to fit the wearer.

2. The dry suit of claim 1, wherein the top front panel of the dry suit body, hanging down in front of the dry suit body when the dry zipper is unzipped, is held in place by joining the right and the left torso panel portions together with fasteners at the front midpoint of the torso portion of the dry suit body.

3. The dry suit of claim 1, wherein one or more pockets are positioned on an exterior surface of at least one of the right and the left torso panel portions.

4. The dry suit of claim 1, wherein the right and the left torso panel portions are not waterproof.

5. A dry suit comprising:

a dry suit body comprising a torso portion, right and left leg portions, and right and left arm portions, and the dry suit body having an access opening;

the access opening being closable by a dry zipper, the dry zipper extending across a back, over each shoulder and down a top front panel of the torso portion of the dry suit body on opposite sides of a neck opening;

the dry suit body having excess dry suit material in a vicinity of armpits of the dry suit body to increase a size of the access opening and facilitate entry and exit of the dry suit by a wearer;

a jacket portion comprising right and left torso panel portions, the right and the left torso panel portions both extending from a shoulder area and terminating above the right and left leg portions of the dry suit body;

the left torso panel portion being attached longitudinally along an exterior left side of the torso portion of the dry suit body by a first waterproof seam and the first waterproof seam extending from an area of a left shoulder to an area of a waist of the torso portion of the dry suit body;

the right torso panel portion being attached longitudinally along an exterior right side of the torso portion of the dry suit body by a second waterproof seam and the second waterproof seam extending from an area of a right shoulder to an area of the waist of the torso portion of the dry suit body;

a first fastener permanently secured along an entire length of an edge of the left torso panel portion and a mating second fastener permanently secured along an entire length of an edge of the right torso panel portion; and during use, the right and left torso panel portions being fastened together, by first and second fasteners, so that the right torso panel portion and the left torso panel portion join one another at a front midpoint of the torso portion of the dry suit body and overlap at least a portion of the dry zipper and at least a front of the torso portion of the dry suit body.

* * * * *